US007204716B1

(12) United States Patent
George et al.

(10) Patent No.: US 7,204,716 B1
(45) Date of Patent: Apr. 17, 2007

(54) SHIELDED ELECTRICAL CONNECTOR AND CONNECTION SYSTEM

(75) Inventors: Terry A. George, Salem, OH (US); Joseph Howard Gladd, Cortland, OH (US); William C Ketterer, Girard, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/365,305

(22) Filed: Mar. 1, 2006

(51) Int. Cl.
*H01R 9/03* (2006.01)

(52) U.S. Cl. ..... 439/610; 439/275; 439/588

(58) Field of Classification Search ..... 439/610, 439/578, 588, 98, 275, 587
See application file for complete search history.

(56) References Cited

U.S. PATENT DOCUMENTS 6,257,931 B1 7/2001 Sakurai et al.
6,554,623 B2 4/2003 Yoshioka
6,659,780 B2 12/2003 Parkinson et al.
6,749,464 B2 * 6/2004 Obata ..... 439/610
6,796,838 B2 * 9/2004 Yoshioka ..... 439/607
2004/0229508 A1 11/2004 Miyazaki et al.

* cited by examiner

*Primary Examiner*—Hae Moon Hyeon
(74) *Attorney, Agent, or Firm*—David P. Wood

(57) ABSTRACT

A shielded electrical connection system comprises a male electrical connector and a female electrical connector that mates with the male electrical connector. The mated electrical connectors have mated terminals that are disposed and sealed in communicating terminal passages of the respective electrical connectors. The electrical connectors also have engaged electromagnetic shields that are disposed and at least partially sealed in communicating shield chambers that are isolated from the mated terminals that are sealed in communicating terminal passages.

11 Claims, 2 Drawing Sheets

SHIELDED ELECTRICAL CONNECTOR AND CONNECTION SYSTEM

FIELD OF THE INVENTION

This invention relates to an electrical connector and connection system that is shielded to prevent electromagnetic interference with electronic devices in the vicinity. Such devices are commonly referred to as electromagnetic interference (EMI) shielded electrical connectors and connection systems.

BACKGROUND OF THE INVENTION

Motor vehicles that use internal combustion engines as well as electric motors to power the vehicle are referred to as hybrid vehicles. Hybrid vehicles use high voltage batteries and power generating devices, such as inverters and DC to DC converters which have a voltage on the order of 42 volts to 500 volts. Electrical connections for the high voltage batteries and power generating devices are typically EMI shielded electrical connections.

Recent developments in hybrid vehicles has resulted in configurations where the power generating devices are electrically connected to a vehicle chassis ground. This has resulted in the need for an EMI shielded electrical connection where the electrical terminals and the shield components of the electrical connection are isolated from each other electrically to avoid establishment of a short circuit between the electrical terminals and the EMI shield.

SUMMARY OF THE INVENTION

In one aspect the invention provides a shielded electrical connector having an insulator body having an inner housing and an outer housing. An inner longitudinal terminal passage extends through the inner housing from a terminal inlet to a terminal outlet. An outer longitudinal shield passage is disposed between the inner housing and the outer housing. A shielded electric cable has a conductive core, an inner insulation jacket, a conductive shield outward of the inner insulation jacket, and an outer insulation jacket outward of the conductive metal shield. A terminal is attached to an end portion of the shielded electric cable in electrical contact with the conductive core. The end portion of the electric cable and the terminal are disposed in the terminal passage of the inner housing with the electric cable extending out of the terminal inlet of the terminal passage. An inner annular elastomeric cable seal engages the inner insulation jacket of the electric cable and the terminal passage to seal the inlet of the terminal passage around the inner insulation jacket of the electric cable and isolate the inner longitudinal terminal passage from the outer longitudinal shield passage.

The outer housing of the shielded electric connector preferably has a shield chamber behind the inner housing for an electromagnetic shield that is in electrical contact with the conductive shield of the electric cable at a location outward of the terminal passage and behind the inner annular elastomeric cable seal.

The shielded electrical connector also preferably includes an outer annular elastomeric cable seal that engages the outer insulation jacket of the electric cable and an inlet to the shield chamber to seal the shield inlet around the outer insulation jacket of the electric cable. The electromagnetic shield may comprise an annulus in the shield chamber that engages the conductive shield of the electric cable, and a finger that extends through the outer longitudinal shield passage.

In another aspect the invention provides a shielded electric connection system comprising the shielded electrical connector and a mating shielded electrical connector that has an inner terminal passage in an inner housing that communicates with the inner terminal passage of the shielded electric connector when the mating shielded electric connector is mated to the shielded electric connector. The shielded electric connection system preferably includes an annular elastomeric connector seal for sealing an interface of the inner housing of the shielded electrical connector and the inner housing of the mating shielded electrical connector.

The mating shielded electric connector preferably has an outer housing and an inner terminal passage that extends through the inner housing from a mating terminal inlet to a mating terminal outlet. A mating terminal is attached to an end of a second cable with the mating terminal being disposed in the inner terminal passage with the second cable extending out of the mating terminal inlet. Preferably, a second annular elastomeric cable seal engages the second cable and the inner terminal passage of the mating shielded connector to seal the mating terminal inlet around the second cable.

A second shield chamber may be formed when the mating shielded electric connector is mated to the shielded connector for a mating electromagnetic shield that contacts the electromagnetic shield of the shielded electric connector when the connectors are mated. A second annular elastomeric connector seal may be provided for sealing a second interface of the mated shielded electric connectors outward of the connector seal mentioned above.

The mating shielded electric connector may be adapted for attachment to a casing and the mating electromagnetic shield may have one or more fingers extending through an outer longitudinal shield passage for grounding the mating electromagnetic shield. A third annular elastomeric connector seal may also be provided for sealing an interface between the mating shielded electric connector and the casing.

DETAILED DESCRIPTION OF PREFERRED EMBODIMENT

Figure 1:
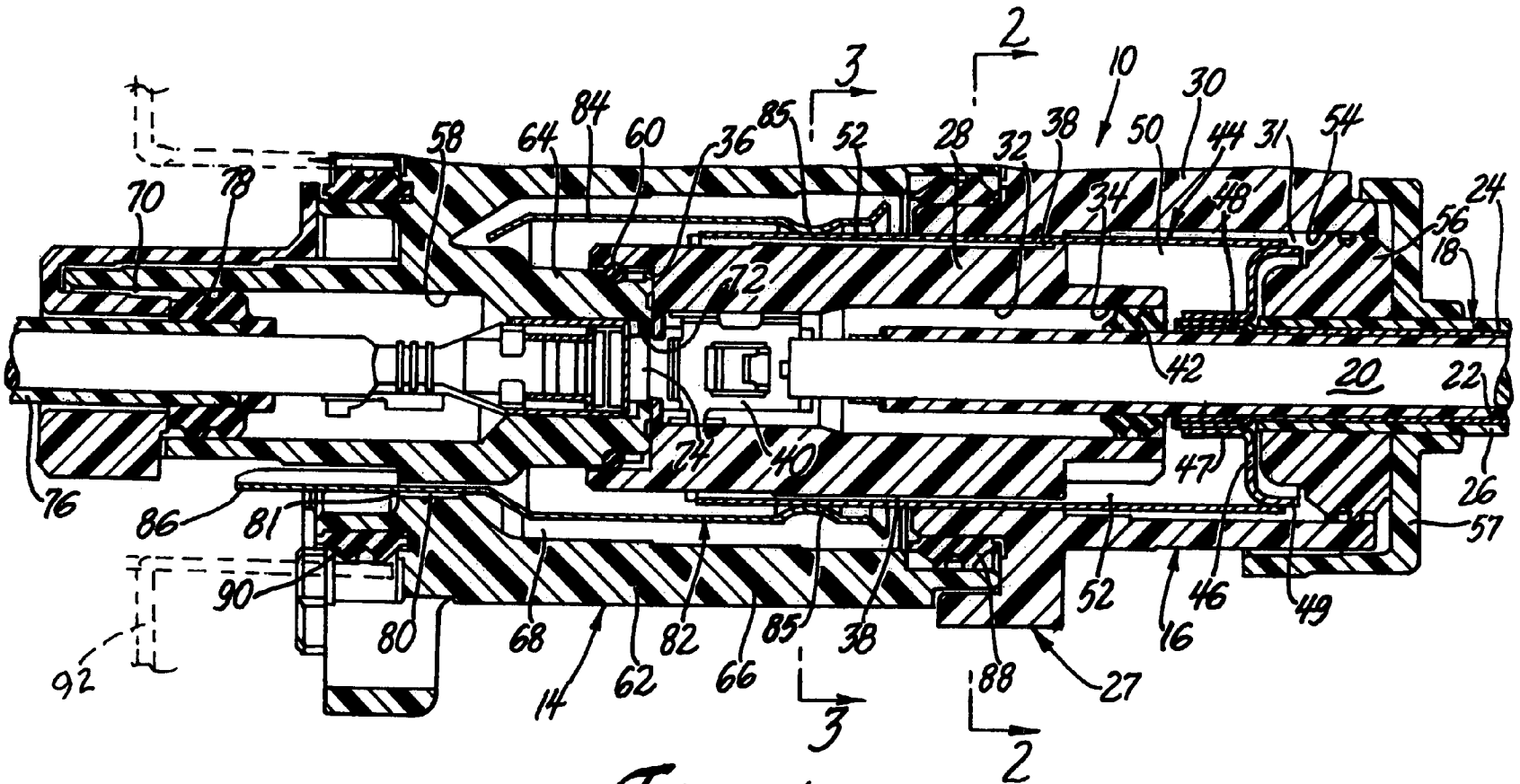
FIG. 1 is a longitudinal section of a shielded electrical connection system of the invention.
Figure 2:
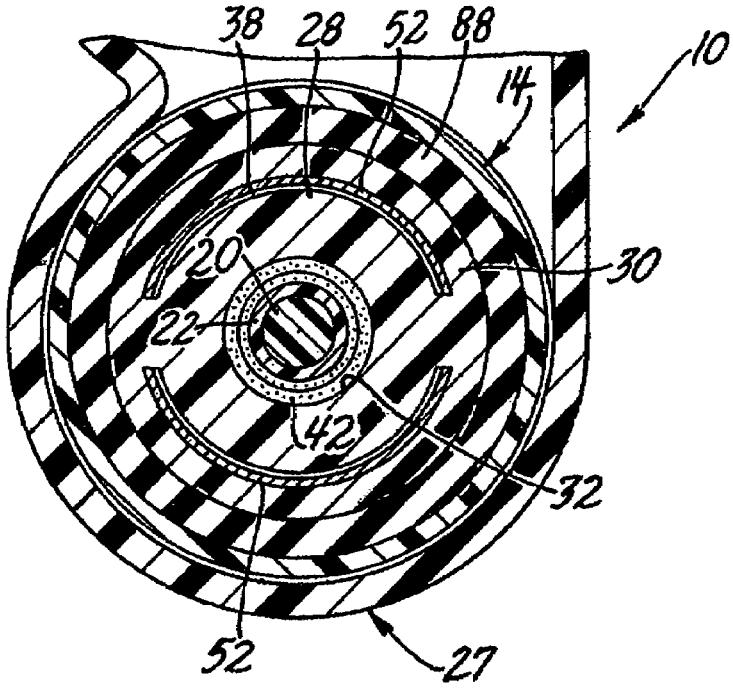
FIG. 2 is a section taken substantially along the line 2—2 of FIG. 1 looking in the direction of the arrows.

Referring now to FIG. 1, the shielded electrical connection system 10 comprises a male connector 14 that is attached to an electrical ground such as a metallic case (not shown), and a female connector 16 that is mated to the male connector 14. As an aside, male connector 14 is labeled male for convenience simply because it contains a male terminal or terminals while female connector 16 is labeled such because it contain a female terminal or terminals. Consequently labels such as male connector or female connector are to be considered terms of convenience and not terms of limitation. For instance, the "female" connector can just as easily house a male terminal and be labeled a "male" male connector without departing from the spirit and scope of the invention. The labels assigned to the connectors 14 and 16 is not important. The important feature is that the connectors 14 and 16 as well as the respective terminals that they contain mate in a connection system.

In one aspect, an important component of the shielded electrical connection system is the female connector 16 that is attached to a shielded electric cable 18 which is hereafter referred simply as shielded electrical connector 16.

By way of background, a shielded electric cable, such as cable 18, comprises a conductive core 20, an inner insulation jacket 22 that surrounds the conductive core 20, an electromagnetic shield 24 that surrounds the inner insulation jacket 22, and an outer insulation jacket 26 that covers the electromagnetic shield 24. Shield 24 is made of a conductive material, usually a metal wire mesh that is woven around the inner insulation jacket 22.

Shielded electrical connector 16 has an insulator body 27 comprising an inner housing 28 and an integral outer housing 30 that extends rearward of the inner housing 28 to provide a first shield chamber 31 behind the inner housing. An inner longitudinal terminal passage 32 extends through inner housing 28 from an inlet 34 that communicates with shield chamber 31 to an outlet 36 at a forward projecting end of the inner housing. A plurality of outer longitudinal shield passages 38 that are disposed between inner housing 28 and outer housing 30 communicate with shield chamber 31.

A female terminal 40 is attached to an end portion of the electrical cable 18 so that the terminal 40 is in electrical contact with the conductive core 20. The end portion of the electric cable 18 and the terminal 40 are disposed in the terminal passage 32 of the inner housing 28 with the electric cable 18 extending out of inlet 34 and through shield chamber 31 behind the inner housing 28.

An inner annular elastomeric cable seal 42 engages the outer surface of the inner insulation jacket 22 of the electric cable 18 and the inner surface of terminal passage 32 to seal the inlet 34 of the terminal passage 32 around the inner insulation jacket 22 of the electric cable 18.

Shielded electrical connector 16 includes an electromagnetic shield 24 that is made of a conductive material and that contacts the conductive shield 24 of electric cable 18 in shield chamber 31 behind cable seal 42. Electromagnetic shield 44 comprises an annulus 46 that has an inner flange 47 that is clamped around an exposed end portion of the electromagnetic shield 24 preferably against a metal clamp ring 48 that is clamped around the inner insulation jacket 22 beneath the exposed portion of shield 44. Electromagnetic shield 44 further comprises a sleeve 50 that fits snugly on an outer flange 49 of annulus 46. Sleeve 50 has a plurality of fingers 52 that extend through respective shield passages 38 with projecting ends that lie adjacent the projecting portion of the inner housing 28.

The electric cable 18 extends out of shield chamber 31 through an inlet 54. An outer annular elastomeric cable seal 56 engages the outer surface of the outer insulation jacket 26 of electric cable 18 and the inner surface of chamber 31 to seal the inlet 54 around the outer insulation jacket 26 of the electric cable 18. The shielded electric connector 16 may include a terminal position assurance (TPA) device 57 to insure that the female terminal 40, the inner cable seal 42 and the outer cable seal 56 are properly positional in insulator body 27. TPA devices are well known in the art and need not be described in detail.

As indicated above, the shielded electric connection system 10 comprises the shielded electrical connector 16 and the mating shielded electrical connector 14. Electrical connector 14 has an inner terminal passage 58 that communicates with the inner terminal passage 32 of the shielded electrical connector 16 when the shielded electrical connector 14 is mated to the shielded electrical connector 16 such as, for example, by inserting a plug end of one inner housing into a socket end of the other inner housing as shown in FIG. 1. An annular elastomeric connector seal 60, for example an elastomeric O-ring, is provided for sealing an interface of the mated electrical connectors 14 and 16.

The mating shielded electric connector 14 also has an insulator body 62 comprising an inner housing 64 and an integral outer housing 66. Inner housing 64 mates with the inner housing 28 of connector 16 as described above. As shown in FIG. 1 of the drawings, the annular elastomeric seal 30 is provided for sealing an interface of the inner housing 28 of shielded electrical connector 16 and the inner housing 64 of the mating shielded electrical connector 14. The outer housing 66 of electrical connector 14 mates with the outer housing 30 of electrical connector 16, such as, for example, by inserting a plug end of one outer housing into a socket end of the other outer housing as shown in FIG. 1. The mated electrical connectors 14 and 16 define a second shield chamber 68 that receives the projecting ends of the fingers 52 of the electromagnetic shield 44.

The mating terminal passage 58 extends through the inner housing 64 from an inlet 70 to an outlet 72. A male terminal 74 that is disposed in the terminal passage 58 that projects out outlet 72 into terminal passage 32 to engage the female terminal 40 when the electrical connectors 14 and 16 are mated.

The male terminal 74 is attached physically and electrically to an end of a non-shielded electric cable 76 that extends out of the inlet 70. A second annular elastomeric cable seal 78 engages the outer insulation jacket of cable 76 to seal the inlet 70 of insulator body 62 around cable 76.

Figure 3:
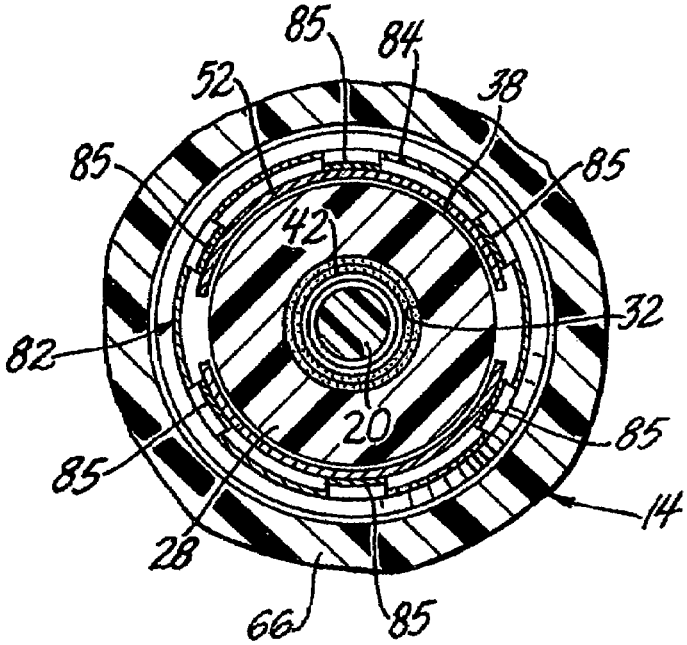
FIG. 3 is a section taken substantially along the line 3—3 of FIG. 1 looking in the direction of the arrows.

The mating shielded electric connector 14 has one or more outer longitudinal shield passages 80 that extend from the second shield chamber 68 to a respective outlet 81. A second electromagnetic shield 82 is disposed in the second shield chamber 68 so that a sleeve 84 of the second electromagnetic shield 82 receives and engages fingers 52 of electromagnetic shield 44 when electrical connectors 14 and 16 are mated as shown in FIG. 1. Sleeve 84 preferably includes resilient contacts 85 to enhance contact with fingers 52 as best shown in FIGS. 1 and 3. Shield 82 has one or more fingers 86 at an end of sleeve 84 that extend through one of the respective passages 80 for grounding electromagnetic shield 82.

The shielded electric connection system 10 further includes a second annular elastomeric connector seal 88 for sealing a second interface of the mated shielded electric connectors 14 and 16 between the outer housings 30 and 66.

The mating shielded connector 14 is usually attached to a casing (shown in dashed line at 92) so that the finger or fingers 86 engage in ground plane (not shown). A third elastomeric seal 90 may be provided to seal an interface between the shielded electric connector 14 and the casing 92 to which it is attached.

Thus the shielded electrical connection system 10 includes a inner electrical path through the connection system 10 having mated terminals 40, 74 in communicating terminal passages 32, 58 that are completely sealed and isolated from an outer shield path having mated shields 44, 82 in communicating shield chambers 31, 68 that are isolated from the mated terminals 40, 74 in the sealed terminal passages 32, 58.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A shielded electrical connector comprising:

an insulator body having an inner housing and an outer housing, an inner longitudinal terminal passage that extends through the inner housing and that has a terminal inlet and a terminal outlet, an outer longitudinal shield passage disposed between the inner housing and the outer housing, the outer longitudinal shield passage being in communication with the terminal inlet of the inner longitudinal terminal passage, a shielded electric cable that has a conductive core, an inner insulation jacket, a conductive shield outward of the inner insulation jacket, and an outer insulation jacket outward of the conductive shield, a terminal that is attached to an end portion of the electric cable and that is in electrical contact with the conductive core, the end portion of the electric cable and the terminal being disposed in a terminal receiving portion of the inner longitudinal terminal passage of the inner housing with the electric cable extending out of the terminal inlet of the terminal passage, and an inner annular elastomeric cable seal that engages the inner insulation jacket of the electric cable and the terminal passage to seal the inlet of the terminal passage around the inner insulation jacket of the electric cable and isolate at least the terminal receiving portion of the inner longitudinal terminal passage electrically from the outer longitudinal shield passage.

2. The shielded electric connector of claim 1 wherein the outer housing has a shield chamber behind the inner housing, wherein the shielded electrical connector further comprises an electromagnetic shield that is disposed in the shield chamber and that is in electrical contact with the conductive shield of the electric cable at a location outward of the terminal passage and behind the inner annular elastomeric cable seal.

3. The shielded electric connector of claim 2 wherein the electric cable extends out of a shield inlet of the shield chamber and wherein the shielded electrical connector includes an outer annular elastomeric cable seal that engages the outer insulation jacket of the electric cable and the shield chamber to seal the shield inlet around the outer insulation jacket of the electric cable.

4. The shielded electrical connector of claim 3 wherein the electromagnetic shield comprises an annulus in the shield chamber that engages the conductive shield of the cable, and a finger that extends through the outer longitudinal shield passage.

5. A shielded electric connection system comprising the shielded electrical connector of claim 1 and a mating shielded electrical connector that has an inner terminal passage in an inner housing that communicates with the inner terminal passage of the shielded electric connector when the mating shielded electric connector is mated to the shielded electric connector, the shielded electric connection system further comprising an annular elastomeric connector seal for sealing an interface of the inner housing of the shielded electrical connector and the inner housing of the mating shielded electrical connector.

6. A shielded electrical connection system comprising:

a shielded electrical connector having an insulator body having an inner housing and an outer housing, an inner longitudinal terminal passage that extends through the inner housing and that has a terminal inlet and a terminal outlet, an outer longitudinal shield passage disposed between the inner housing and the outer housing, the outer longitudinal shield passage being in communication with the terminal inlet of the inner longitudinal terminal passage, a shielded electric cable that has a conductive core, an inner insulation jacket, a conductive shield outward of the inner insulation jacket, and an outer insulation jacket outward of the conductive shield, a terminal that is attached to an end portion of the electric cable and that is in electrical contact with the conductive core, the end portion of the electric cable and the terminal being disposed in a terminal receiving portion of the inner longitudinal terminal passage of the inner housing with the electric cable extending out of the terminal inlet of the terminal passage, an inner annular elastomeric cable seal that engages the inner insulation jacket of the electric cable and the terminal passage to seal the inlet of the terminal passage around the inner insulation jacket of the electric cable and isolate at least the terminal receiving portion of the inner longitudinal terminal passage electrically from the outer longitudinal shield passage, the outer longitudinal shield passage including a shield chamber behind the inner housing, an electromagnetic shield that is disposed in the shield chamber and that is in electrical contact with the conductive shield of the electric cable outward of the terminal passage and the inner annular elastomeric cable seal, a mating shielded electrical connector that has an inner terminal passage in an inner housing that communicates with the inner terminal passage of the shielded electric connector when the mating shielded electric connector is mated to the shielded electric connector, and an annular elastomeric connector seal for sealing an interface of the inner housing of the shielded electrical connector and the inner housing of the mating shielded electrical connector.

7. The shielded electric connection system of claim 6 wherein the mating shielded electric connector has an outer housing, wherein the inner terminal passage extends through the inner housing from a mating terminal inlet to a mating terminal outlet, wherein the shielded electric connection system further includes a mating terminal that is attached to an end of a second cable, wherein the mating terminal is disposed in the inner terminal passage with the second cable extending out of the mating terminal inlet, and wherein the shielded electric connection system further includes a second annular elastomeric cable seal that engages the second cable and the inner terminal passage of the mating shielded connector to seal the mating terminal inlet around the second cable.

8. The shielded electrical connection system of claim 7 wherein a second shield chamber is formed when the mating shielded electric connector is mated to the shielded connector and wherein the shielded electric connector system further comprises a mating electromagnetic shield that is disposed in the second shield chamber and that is in contact with the electromagnetic shield of the shielded electric connector.

9. The shielded electrical connection system of claim 8 further including a second annular elastomeric connector seal for sealing a second interface of the mated shielded electric connectors outward of the connector seal.

10. The shielded electric connection system of claim 9 wherein the mating shielded electric connector is adapted for attachment to a casing, wherein the mating electromagnetic shield has a longitudinal finger extending through an outer longitudinal shield passage for grounding the mating electromagnetic shield, and wherein the shielded electric connection system includes a third annular elastomeric connector seal outward of the longitudinal finger for sealing an interface between the mating shielded electric connector and the casing.

11. A shielded electric connector adapted for attachment to a casing, the shielded electrical connector having an inner terminal passage in an inner housing that extends through inner housing from a terminal inlet to a terminal outlet, a terminal that is attached to an end of a cable, the terminal being disposed in the inner terminal passage with the cable extending out of the terminal inlet, an annular elastomeric cable seal that engages the cable and the inner terminal passage of the shielded connector to seal the terminal inlet around the cable, the shielded electric connector having an outer housing, a shield chamber formed by the outer housing and the inner housing, an electromagnetic shield disposed in the shield chamber, the electromagnetic shield having a longitudinal finger extending through an outlet of the shield chamber for grounding the electromagnetic shield, and an annular elastomeric connector seal outward of the longitudinal finger for sealing an interface between the shielded electric connector and the casing.

* * * * *